US009238298B2

(12) United States Patent
Wu et al.

(10) Patent No.: US 9,238,298 B2
(45) Date of Patent: Jan. 19, 2016

(54) TWO-SWITCH DEVICE FOR AN ELECTRIC NAIL GUN

(75) Inventors: Jian-Rung Wu, Taichung (TW); Chien-Kuo Po, Taichung (TW)

(73) Assignee: Basso Industry Corp., Taichung (TW)

( * ) Notice: Subject to any disclaimer, the term of this patent is extended or adjusted under 35 U.S.C. 154(b) by 780 days.

(21) Appl. No.: 13/287,108

(22) Filed: Nov. 1, 2011

(65) Prior Publication Data

US 2012/0104070 A1 May 3, 2012

(30) Foreign Application Priority Data

Nov. 3, 2010 (TW) ..... 099137770 A

(51) Int. Cl.
*B25C 1/06* (2006.01)
*B25C 1/00* (2006.01)

(52) U.S. Cl.
CPC .. *B25C 1/008* (2013.01); *B25C 1/06* (2013.01)

(58) Field of Classification Search
CPC ..... B25C 1/00; B25C 1/04; B25C 1/06; B25C 1/15; B25C 1/008; B25C 1/043; B25C 5/15
USPC ..... 227/8, 130, 2, 120, 129, 131, 133, 147; 173/90, 213
See application file for complete search history.

(56) References Cited

U.S. PATENT DOCUMENTS

| | | | | |
|---|---|---|---|---|
| 5,522,532 | A * | 6/1996 | Chen | 227/8 |
| 5,785,228 | A * | 7/1998 | Fa et al. | 227/8 |
| 6,543,664 | B2 * | 4/2003 | Wolfberg | 227/8 |
| 6,588,642 | B1 * | 7/2003 | Wang et al. | 227/8 |
| 6,857,547 | B1 * | 2/2005 | Lee | 227/8 |
| 6,929,165 | B1 * | 8/2005 | Chen et al. | 227/8 |
| 6,997,367 | B2 * | 2/2006 | Hu | B25C 5/15 173/202 |
| 7,004,367 | B1 * | 2/2006 | Shen et al. | 227/8 |
| 7,322,502 | B1 * | 1/2008 | Sun | 227/8 |
| 2010/0038397 | A1 * | 2/2010 | Krondorfer et al. | 227/8 |
| 2010/0102102 | A1 * | 4/2010 | Matsunaga et al. | 227/8 |
| 2010/0116863 | A1 * | 5/2010 | Suda | 227/8 |
| 2011/0248062 | A1 * | 10/2011 | Fujimoto | B25C 1/06 227/8 |

* cited by examiner

*Primary Examiner* — Gloria R Weeks
*Assistant Examiner* — Justin Citrin
(74) *Attorney, Agent, or Firm* — The Mueller Law Office, P.C.

(57) ABSTRACT

A two-switch device is used for an electric nail gun. The electric nail gun includes a safety member movable to press against an article to thereby move in the gun body, a kinetic power unit for generating kinetic energy, an impact unit for outputting kinetic energy to perform a nail-striking operation, and a transmission unit for transmitting the kinetic energy. The two-switch device includes a first electrical control unit controlled by a trigger and the safety member for driving the kinetic power unit, and a second electrical control unit controlled by an inner plate for driving the transmission unit. By controlling actuation order of the safety member and the trigger, the electric nail gun can be changed between a single shot mode and a continuous shooting mode.

8 Claims, 8 Drawing Sheets

TWO-SWITCH DEVICE FOR AN ELECTRIC NAIL GUN

CROSS-REFERENCE TO RELATED APPLICATION

This application claims priority of Taiwanese Application No. 099137770, filed on Nov. 3, 2010.

BACKGROUND OF THE INVENTION

1. Field of the Invention

This invention relates to a switch device, and more particularly to a two-switch device for an electric nail gun.

2. Description of the Related Art

A conventional electric nail gun typically includes a trigger and a control circuit. The trigger can be actuated to activate the control circuit to generate an electrical control signal for performing a nail-driving operation.

However, the operation mode of the electric nail gun is based on the electrical control signal. To change between a signal shot mode and a continuous shooting mode, there is a need for providing a change-over switch, which leads easily to complication of the control circuit, an increase in the cost, and an electrical failure caused by the surrounding interference.

SUMMARY OF THE INVENTION

The object of this invention is to provide a two-switch device for an electric nail gun that has a simple structure and that can enhance convenience and utility during use.

Accordingly, a two-switch device of this invention is adapted for use in an electric nail gun. The electric nail gun is used for driving a nail into an article, and includes a gun body, a safety member movable to press against the article to thereby move in the gun body, a kinetic power unit disposed in the gun body for generating kinetic energy, an impact unit for outputting kinetic energy to perform a nail-striking operation, and a transmission unit for transmitting the kinetic energy from the kinetic power unit to the impact unit. The two-switch device includes a trigger unit, a first electrical control unit, and a second electrical control unit. The trigger unit includes a trigger adapted to be disposed pivotally on the gun body, and an inner plate disposed pivotally on the trigger such that, when the safety member is pressed against the article to move in the gun body, the inner plate is driven by the safety member to move in the gun body. The inner plate is connected to the safety member in such a manner that, when in a single shot mode, a nail-striking operation results in removal of the inner plate from the safety member, and when in a continuous shooting mode, the nail-striking operation does not result in removal of the inner plate from the safety member. The first electrical control unit is adapted to be disposed in the gun body, and is aligned with the trigger and the safety member. The first electrical control unit is contactable with one of the trigger and the safety member, which is first operated to contact the first electrical control unit, to output a first electrical control signal for driving the kinetic power unit. The second electrical control unit is adapted to be disposed in the gun body, and is aligned with the inner plate. The second electrical control unit is contactable with the inner plate so as to output a second electrical control signal for driving the transmission unit.

The effect of this invention is that, by controlling actuation order of the trigger unit and the safety member, the electric nail gun can be changed between a single shot mode and a continuous shooting mode, thereby enhancing convenience and utility during use.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
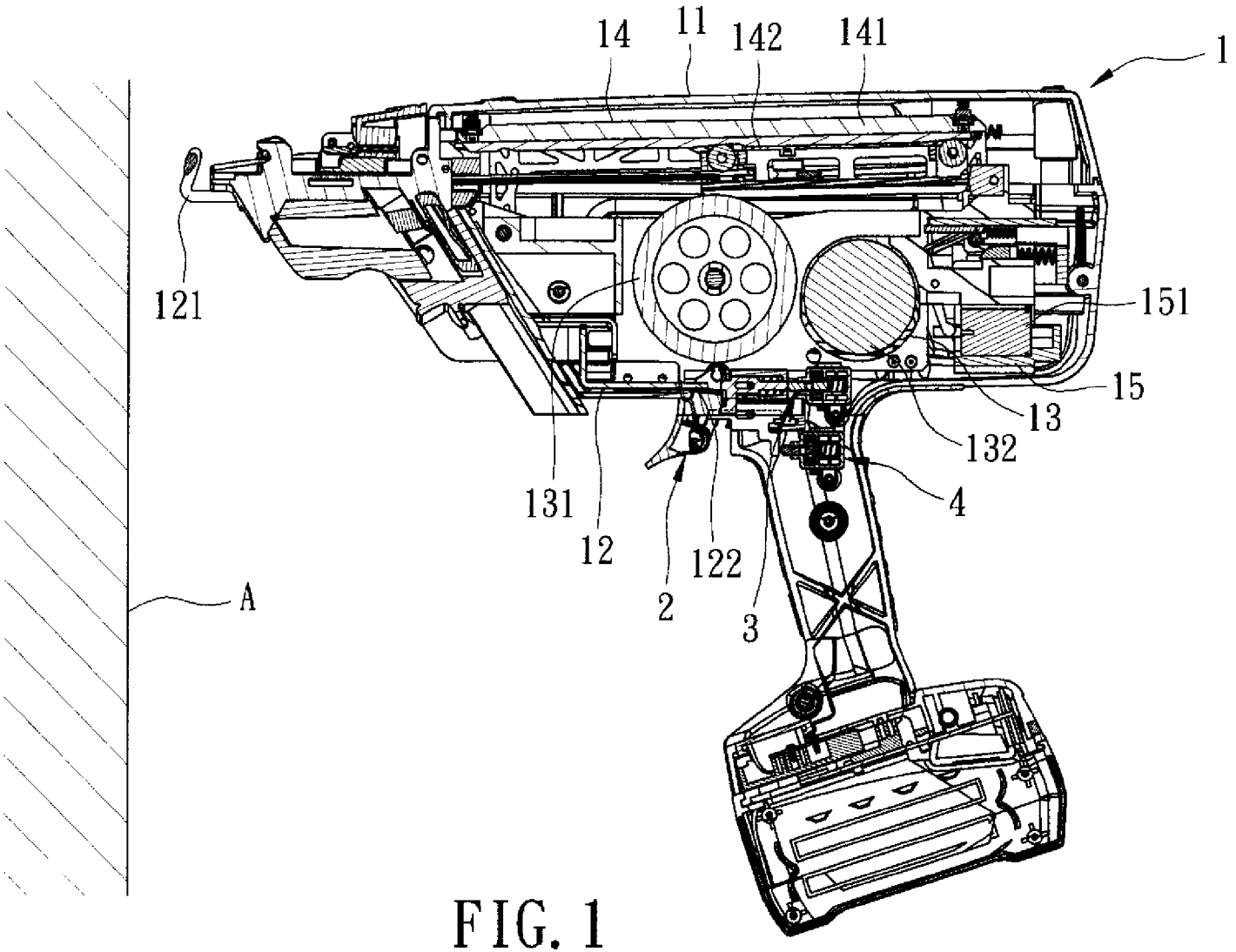
FIG. 1 is a sectional view of the preferred embodiment of a two-switch device for an electric nail gun according to this invention.
Figure 2:
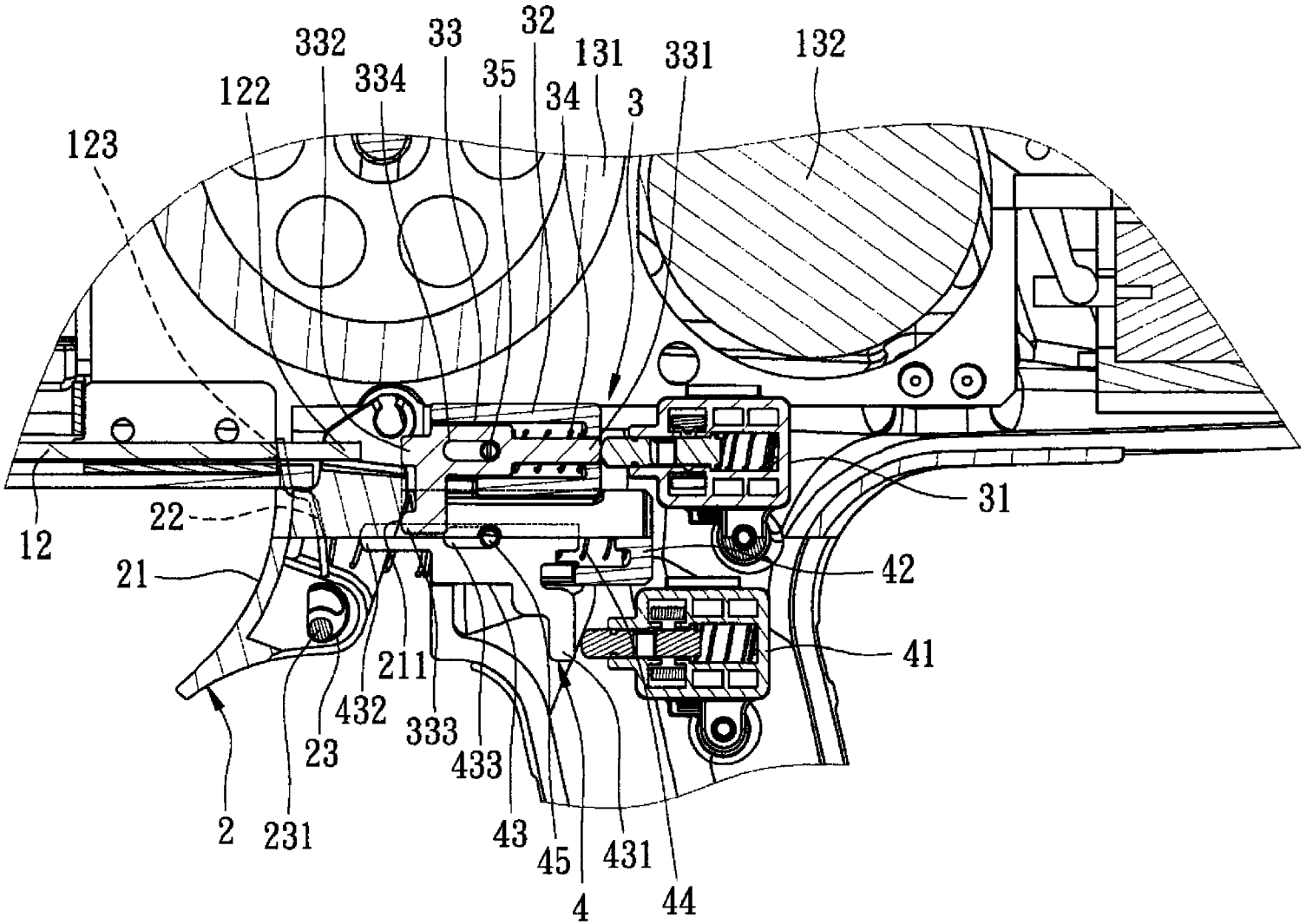
FIG. 2 is a fragmentary sectional view of the preferred embodiment, illustrating that a safety member is at a normal position and an inner plate is at a high point position.

Referring to FIGS. 1 and 2, the preferred embodiment of a two-switch device according to this invention is used in an electric nail gun 1. The electric nail gun 1 is adapted for driving a nail (not shown) into an article (A), and includes a gun body 11, a safety member 12 movable in the gun body 11, a kinetic power unit 13 disposed in the gun body 11 for generating kinetic energy, an impact unit 14 for outputting kinetic energy to perform a nail-striking operation, and a transmission unit 15 for transmitting kinetic energy from the kinetic power unit 13 to the impact unit 14. The safety member 12 has a pressing portion 121 disposed at one end thereof and projecting from the gun body 11, an abutting portion 122 disposed at the other end thereof, and a notch 123 formed in the abutting portion 122. The kinetic power unit 13 includes a flywheel 131 disposed rotatably on the gun body 11, and a motor unit 132 for driving the flywheel 131. The impact unit 14 includes a swing arm 141 disposed pivotally on the gun body 11, and an impact member 142 disposed movably on the swing arm 141. The transmission unit 15 includes an electromagnetic valve 151 for driving the swing arm 141 to move the impact member 192 into contact with the flywheel 131. The two-switch device includes a trigger unit 2, a first electrical control unit 3, and a second electrical control unit 4.

Figure 2A:
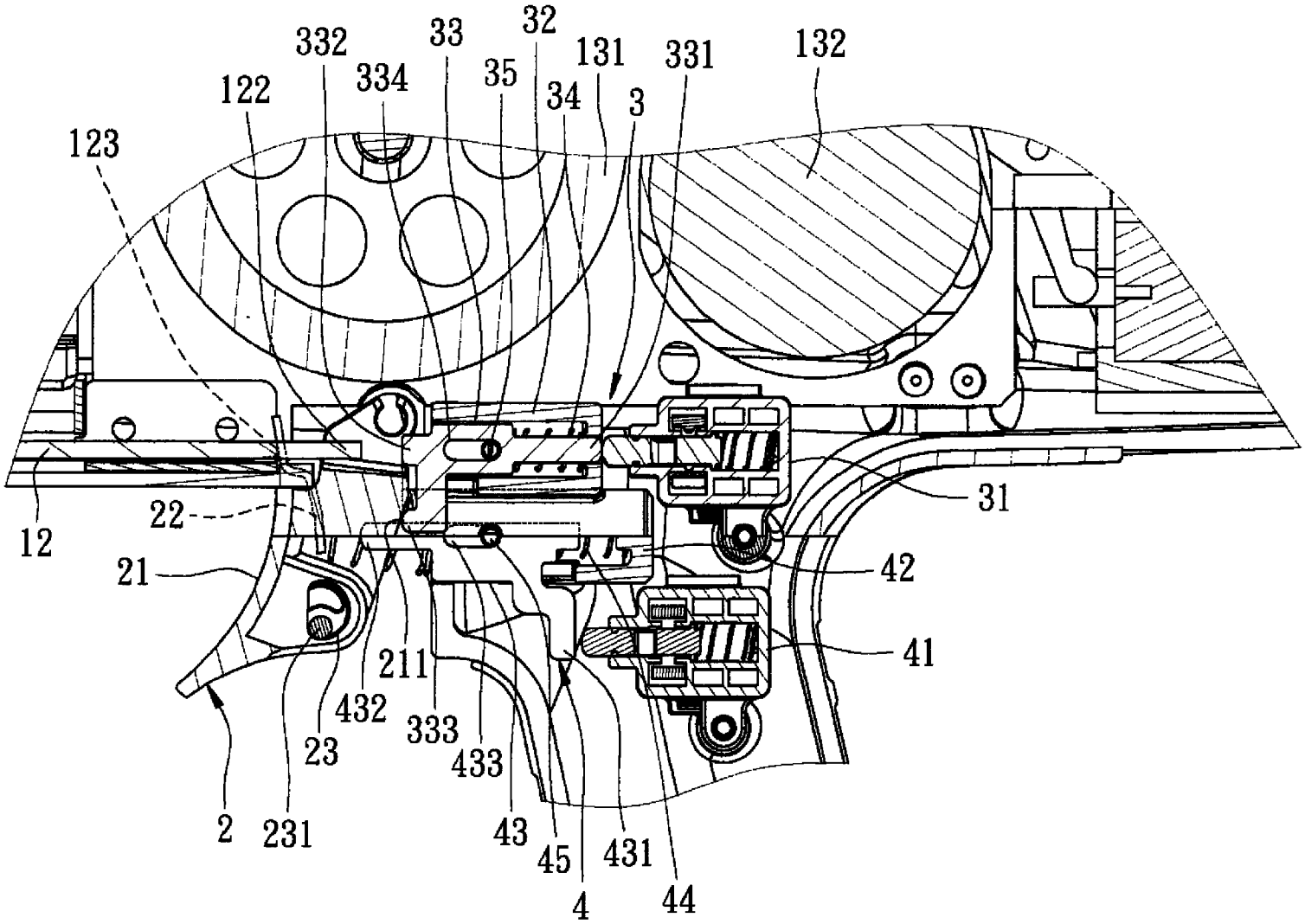
FIG. 2A is a view similar to FIG. 2 but illustrating that the inner plate is at a lower point position.

The trigger unit 2 includes a trigger 21 disposed pivotally on the gun body 11 and permitting extension of the safety member 12 therethrough, an inner plate 22 disposed pivotally on the trigger 21, and a rotating member 23. The trigger 21 has an abutment surface 211. The inner plate 22 abuts against the safety member 12, and engages the notch 123. The rotating member 23 is provided with an eccentric pin 231 connected pivotally to a lower end of the inner plate 22. By rotating the rotating member 23, the inner plate 22 is movable between a high point position shown in FIG. 2A and a lower point position shown in FIG. 2.

The first electrical control unit 3 includes a contact switch 31, a mounting member 32, a touch member 33, a resilient member 34, and a limiting pin 35. The contact switch 31 is disposed in the gun body 11, is aligned with the trigger unit 2 and the safety member 12, and is electrically connected to the motor unit 132. The mounting member 32 is disposed between the contact switch 31 and the trigger unit 2. The touch member 33 extends movably through the mounting member 32, and has a contact portion 331 aligned with the contact switch 31, a pair of first and second protrusions 332, 333 aligned respectively with the abutting portion 122 of the safety member 12 and the abutment surface 211, and a slot 334 formed between the contact portion 331 and the first protrusion 332. The resilient member 34 is disposed between the mounting member 32 and the touch member 33 for biasing the touch member 33 away from the contact switch 31. The limiting pin 35 extends movably through the mounting member 32 and the slot 334 in the touch member 33 for limiting movement of the touch member 33 between two positions. The abutment surface 211 of the trigger 21 faces toward the first electrical control unit 3.

The second electric control unit 4 includes a contact switch 41, a mounting member 42, a touch member 43, a resilient member 44, and a limiting pin 45. The contact switch 41 is disposed in the gun body 11, is aligned with the trigger unit 2, and is electrically connected to the electro-magnetic valve 151. The mounting member 42 is disposed between the contact switch 41 and the inner plate 22. The touch member 43 extends movably through the mounting member 42, and has a contact portion 431 aligned with the contact switch 41, a protrusion 432 aligned with the inner plate 22, and a slot 433 formed between the contact portion 431 and the protrusion 432. The resilient member 44 is disposed between the mounting member 42 and the touch member 43 for biasing the touch member 43 away from the contact switch 41. The limiting pin 45 extends movably through the mounting member 42 and the slot 433 in the touch member 43 for limiting movement of the touch member 43 between two positions.

Figure 3:
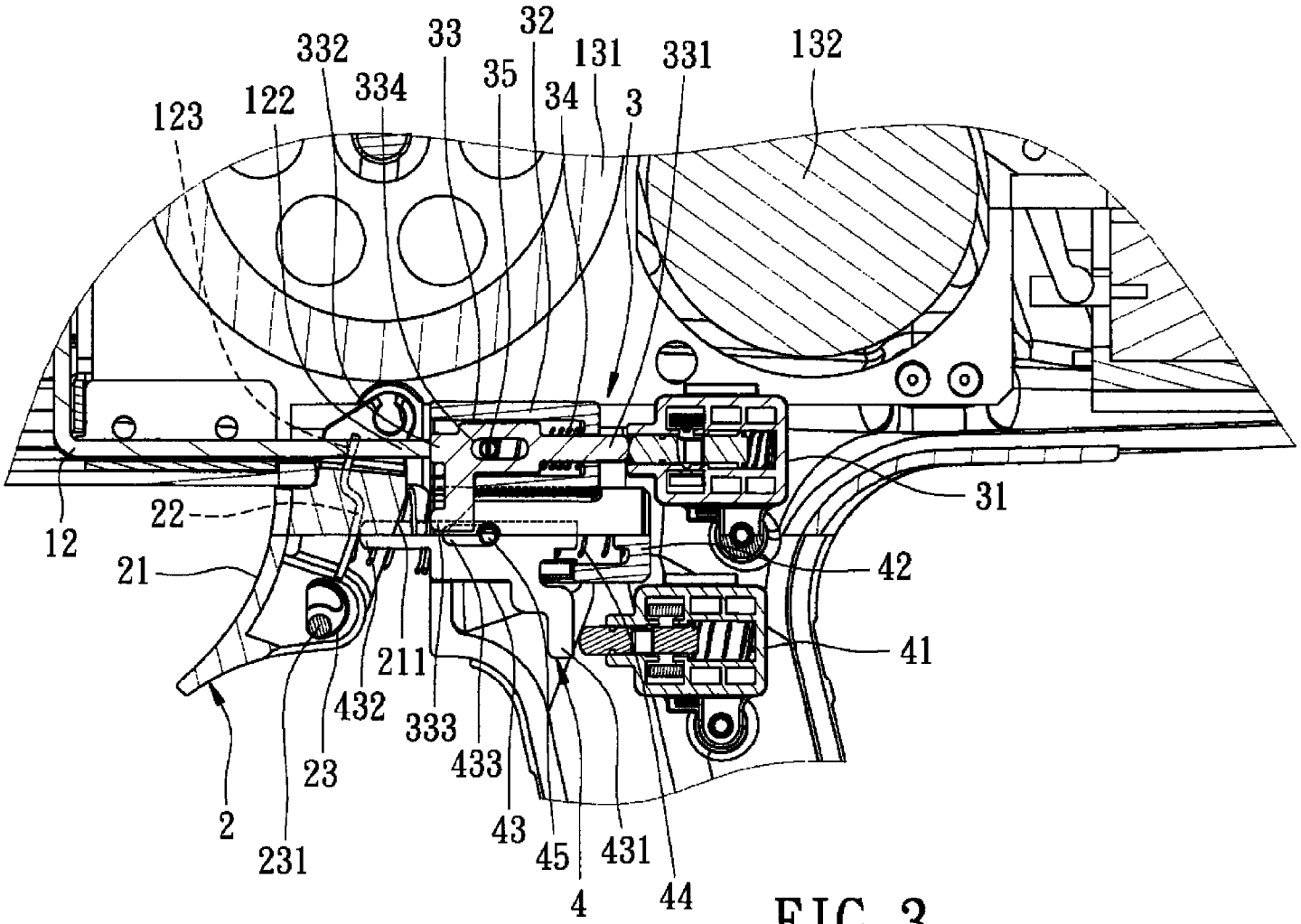
FIG. 3 is a view similar to FIG. 2 but illustrating that the safety member comes into contact with a first electrical control unit for generating a first electrical control signal.
Figure 4:
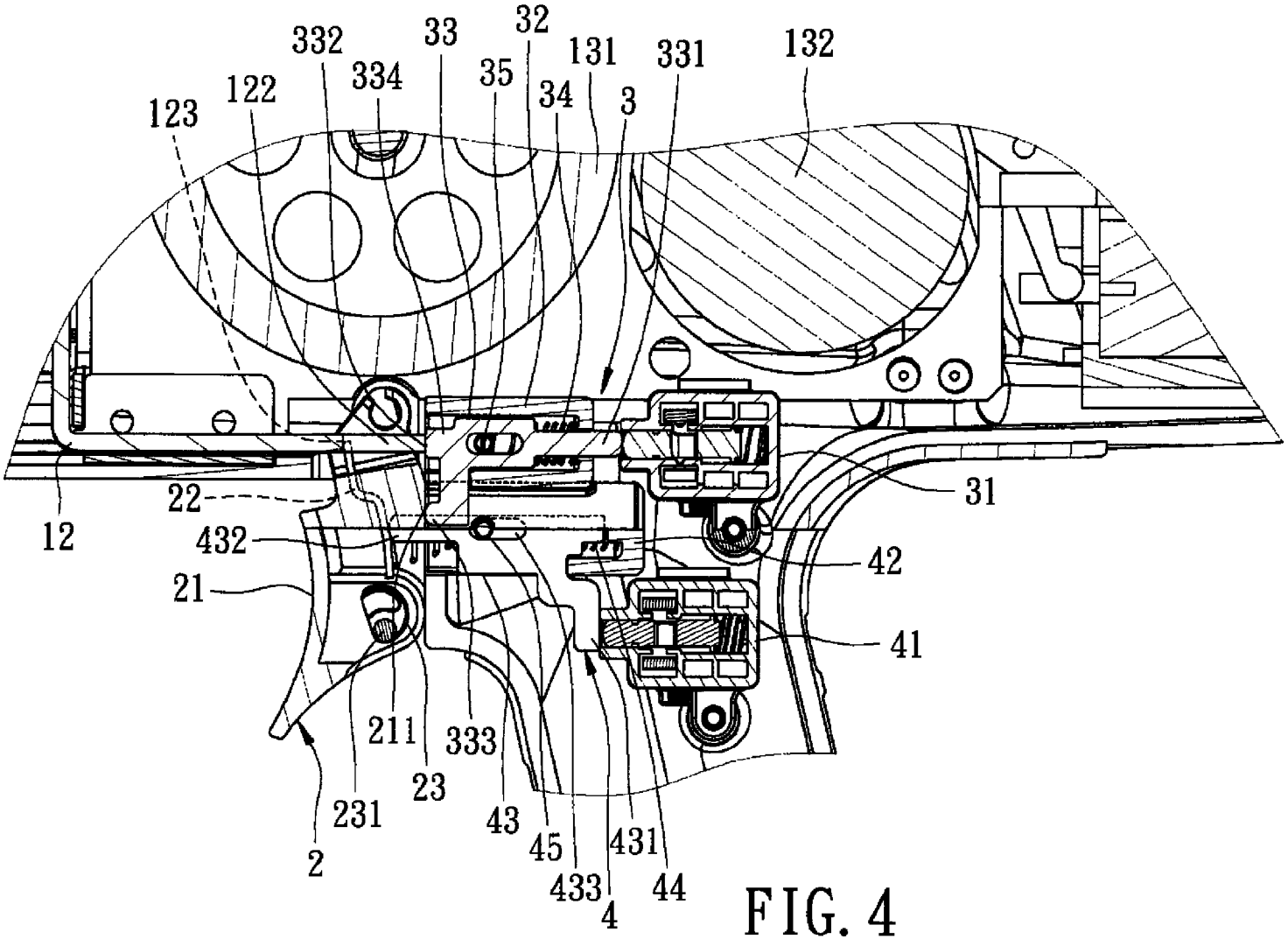
FIG. 4 is a view similar to FIG. 2 but illustrating that the inner plate comes into contact with a second electrical control unit for generating a second electrical control signal when the electric nail gun is operated in a single shot mode.

The electric nail gun can be operated in single shot mode by:

(1) rotating the rotating member 23 and, thus, the eccentric pin 231 to move the inner plate 22 to the lower point position, so that an upper end of the inner plate 22 is slightly above and spaced apart from that of the abutting portion 122 of the safety member 12 by a first distance;

(2) pressing the pressing portion 121 of the safety member 12 against the article (A) to move the safety member 12 in the gun body 11, so that the abutting portion 122 moves the touch member 33 of the first electrical control unit 3 into contact with the contact switch 31 against the biasing action of the resilient member 34 for generating the first electrical control signal to activate the motor unit 132 to thereby rotate the flywheel 131 at a high speed, as shown in FIG. 3, and so that a wall defining the notch 123 pushes the inner plate 22 into contact with the protrusion 432 of the second electrical control unit, as shown in FIG. 4; and (3) actuating the trigger 21 to rotate the inner plate 22 so as to move the touch member 43 of the second electrical control unit 4 into contact with the contact switch 41 for generating the second electrical control signal, generation of the second electrical control signal resulting in activation of the electro-magnetic valve 151 to rotate the swing arm 141 to move the impact member 142 into contact with the flywheel 131, so that the impact member 142 is moved by the flywheel 131 to strike the nail.

Figure 5:
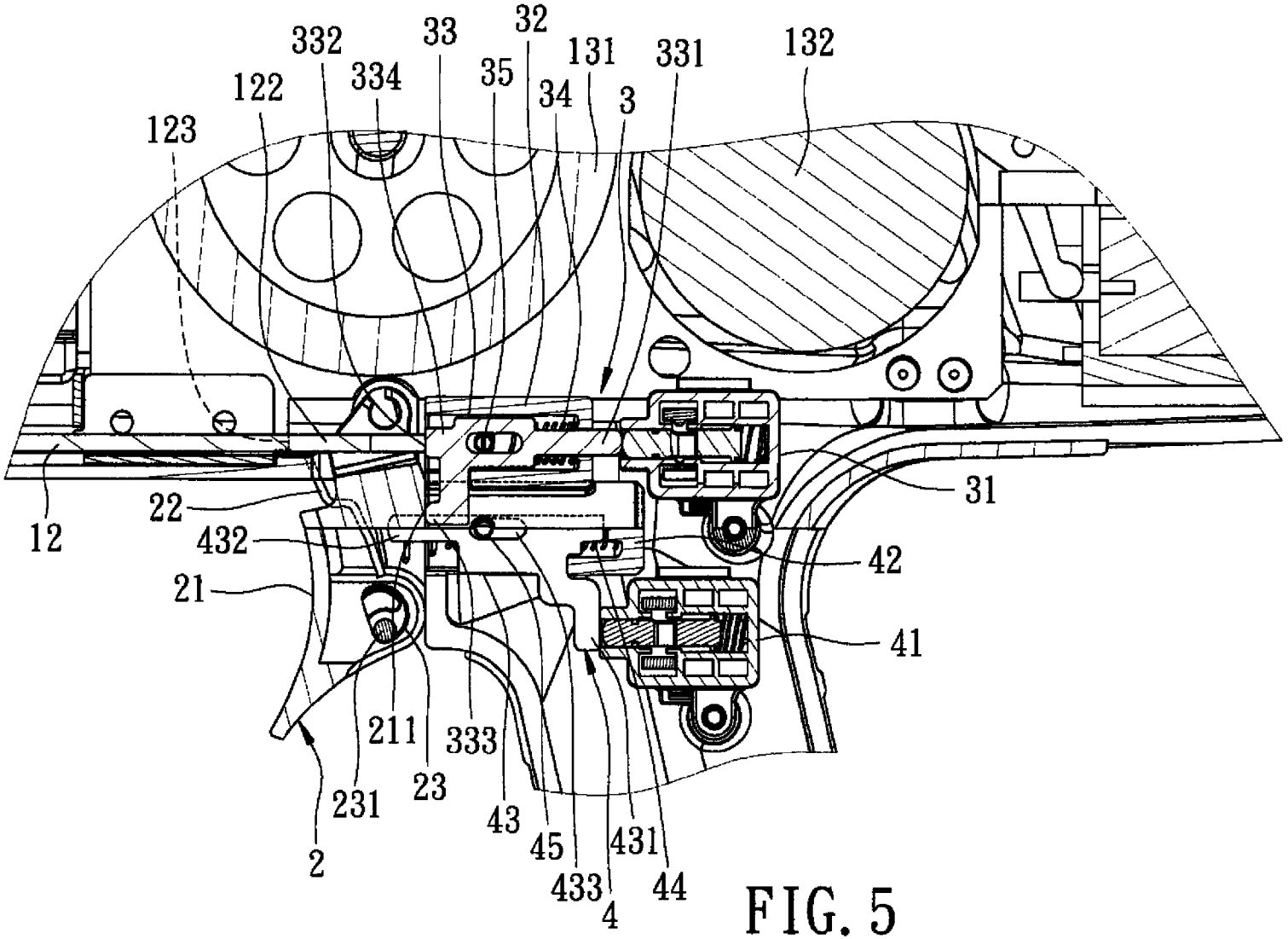
FIG. 5 is a view similar to FIG. 2 but illustrating that the inner plate and the safety member are separated from each other.

In the single shot mode, due to a backlash occurring during the nail-striking operation, the safety member 12 moves forwardly from the position shown in FIG. 4 relative to the gun body 11 by a small distance. That is, the safety member 12 moves to the position shown in FIG. 5, where the inner plate 22 will rotate to disengage the notch 123 to thereby separate from the safety member 12. At this time, since the inner plate 22 is disengaged from the notch 123 in the safety member 12, the touch member 42 cannot be moved to contact the contact switch 41 so that, when a subsequent nail-striking operation is desired, it is necessary to first remove the safety member 12 from the article (A) and release the trigger 21. Next, the pressing portion 121 of the safety member 12 is pressed against the article (A), and then the trigger 21 is actuated.

Figure 6:
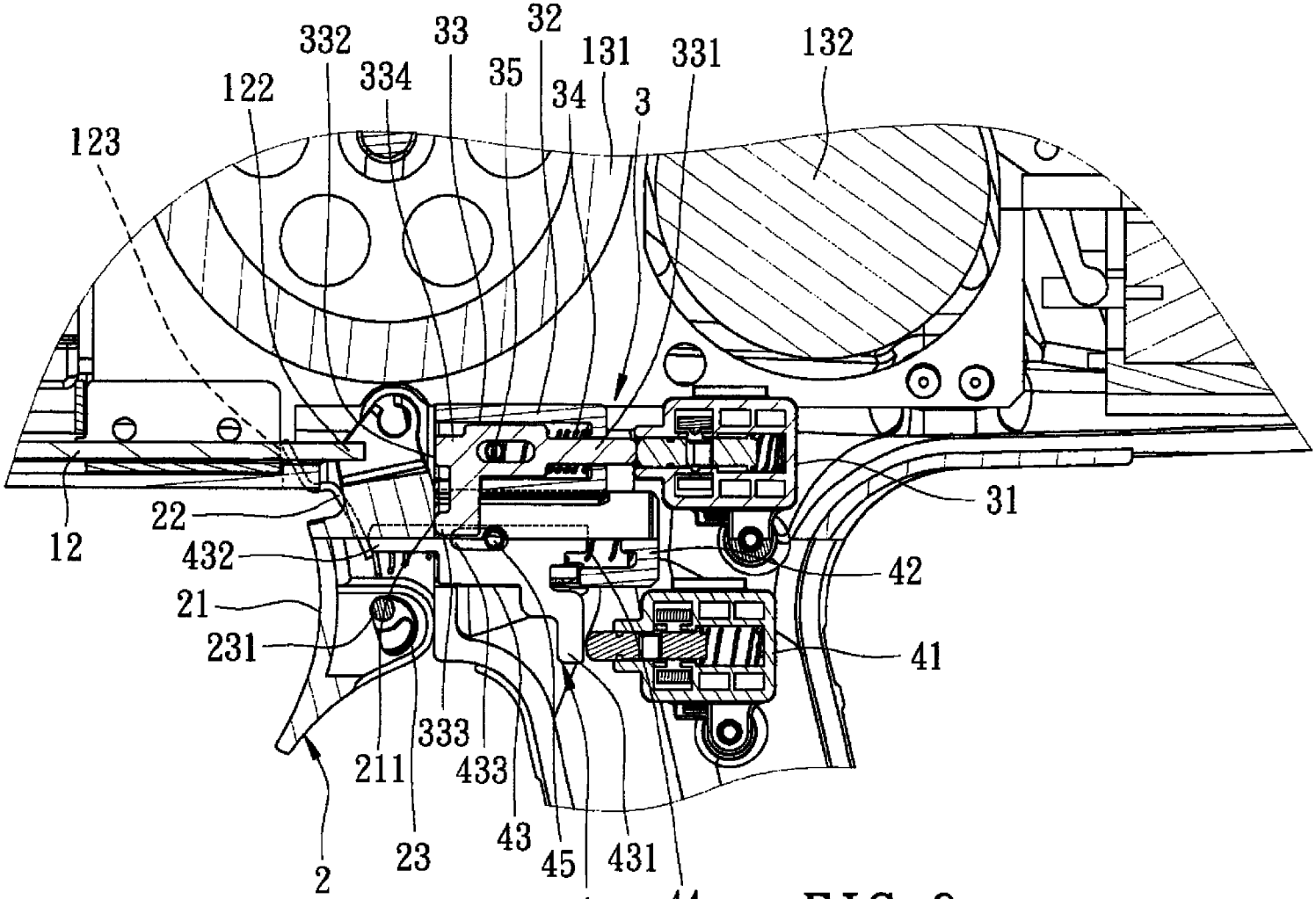
FIG. 6 is a view similar to FIG. 2 but illustrating that a trigger comes into contact with the first electrical control unit for generating the first electrical control signal.
Figure 7:
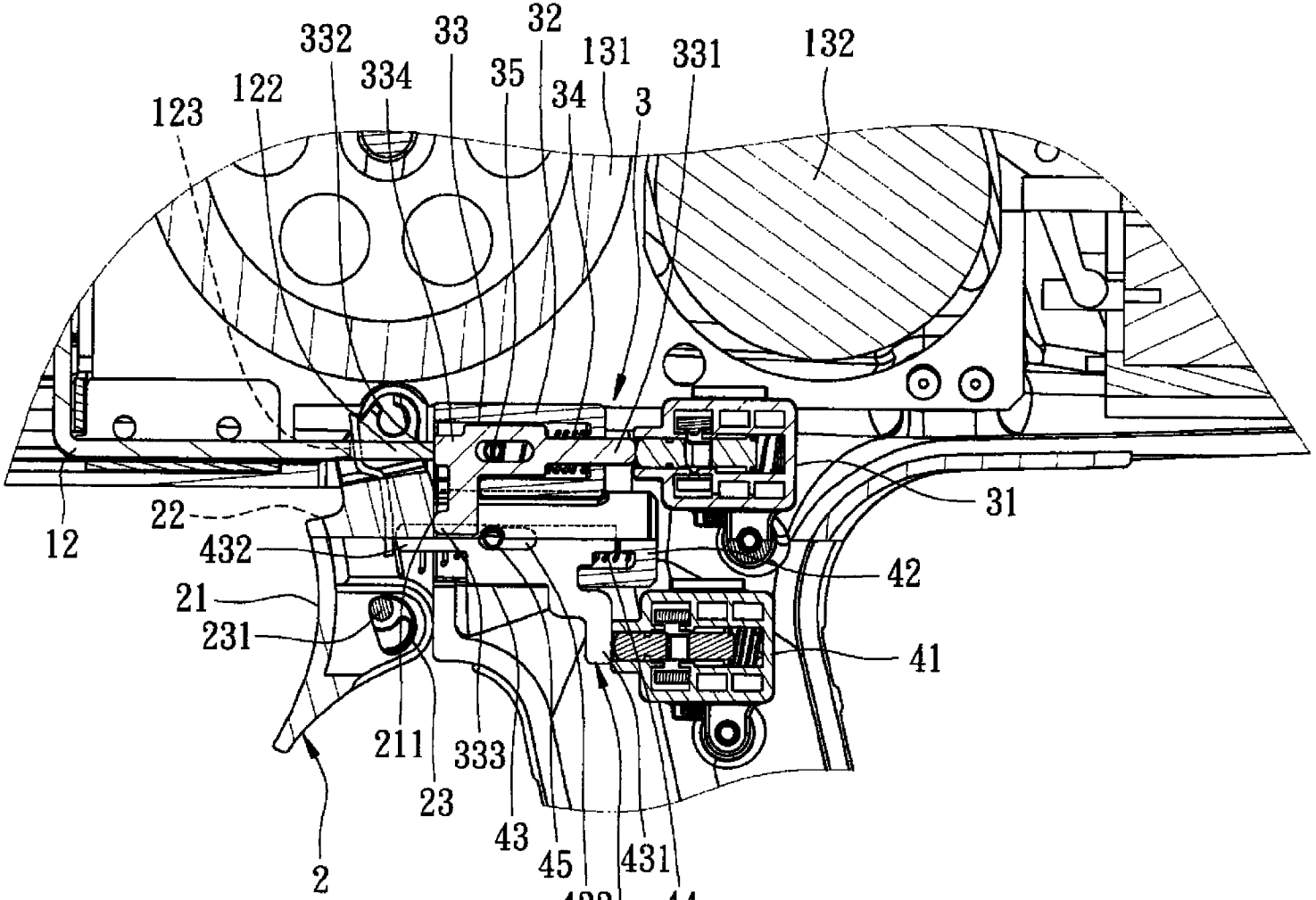
FIG. 7 is a view similar to FIG. 2 but illustrating that the inner plate comes into contact with the second electrical control unit for generating the second electrical control signal when the electric nail gun is operated in a continuous shooting mode.

Or, the electric nail gun can be operated in a continuous shooting mode by:

(1) rotating the rotating member 23 and, thus, the eccentric pin 231 to move the inner plate 22 to the high point position, so that the upper end of the inner plate 22 is above and spaced apart from that of the abutting portion 122 of the safety member 12 by a second distance that is much greater than the first distance;

(2) actuating the trigger 21 to allow the touch member 33 to be moved by the abutment surface 211 to contact the contact switch 31, as shown in FIG. 6, so that the first electrical control signal is generated, thereby resulting in activation of the motor unit 132 and rotation of the flywheel 131; and (3) pressing the pressing portion 121 of the safety member 12 against the article (A) to move the safety member 12 in the gun body 11, so that the inner plate 22 is moved by the wall defining the notch 123 to push the touch member 43 into contact with the contact switch 41, as shown in FIG. 7, thereby generating the second electrical control signal to perform a nail-striking operation.

In the continuous shooting mode, since the inner plate 22 is at the high point position, a backlash occurring during the nail-striking operation cannot results in separation of the inner plate 22 from the safety member 12. Hence, after one nail-striking operation is completed, when a subsequent nail-striking operation is desired, it is only necessary to remove the safety member 12 from the article (A) and then press against the safety member 12 against the article (A). That is, release of the trigger 21 is not necessary.

In view of the above, the two-switch device of this invention has the following advantages:

(1) The single shot mode and the continuous shooting mode can be changed with ease by controlling actuation order of the trigger unit 2 and the safety member 12, thereby resulting in convenience and utility during use of the electric nail gun.

(2) A relatively long time interval occurs between generation of the first and second electrical control signals (i.e. actuation of the contact switches 31, 41 of the first and second electrical control units 3, 4). As such, while the impact member 142 comes into contact with the flywheel 131, the flywheel 131 is rotating stably at a high speed, so as to facilitate smooth nail-striking operation and promote the nail-striking effect.

With this invention thus explained, it is apparent that numerous modifications and variations can be made without departing from the scope and spirit of this invention. It is therefore intended that this invention be limited only as indicated by the appended claims.

We claim:

1. An electric nail gun adapted for driving a nail into an article, comprising a gun body, a safety member movable to press against the article to thereby move in the gun body, a kinetic power unit disposed in the gun body for generating kinetic energy, an impact unit for outputting kinetic energy to perform a nail-striking operation, a transmission unit for transmitting the kinetic energy from the kinetic power unit to the impact unit, and a two-switch device including:

a trigger unit including a trigger adapted to be disposed pivotally on the gun body, and an inner plate disposed pivotally on said trigger such that, when said safety member is pressed against the article to move in the gun body, said inner plate is driven by said safety member to move in the gun body, said inner plate being connected to said safety member in such a manner that, when in a single shot mode, a nail-striking operation results in removal of said inner plate from said safety member, and when in a continuous shooting mode, the nail-striking operation does not result in removal of said inner plate from said safety member;

a first electrical control unit adapted to be disposed in the gun body, said first electrical control unit being contactable with both of said trigger and said safety member, and outputting a first electrical control signal for driving electrically said kinetic power unit upon being contacted by one of said trigger and said safety member, whichever is first operated; and a second electrical control unit adapted to be disposed in the gun body, said second electrical control unit being contactable with said inner plate so as to output a second electrical control signal for driving electrically said transmission unit;

wherein said first electrical control unit includes a contact switch and a touch member movable relative to said contact switch and having a contact portion, and two protrusions contactable respectively with and movable by said safety member and said trigger to allow said contact portion to move into contact with said contact switch to output the first electrical control signal;

wherein, in the single shot mode, (i) said inner plate is set in a lower point position relative to said trigger, (ii) the safety member is pressed against the article to contact said first electrical control unit so as to generate the first electrical control signal for driving electrically said kinetic power unit, and (iii) said trigger is depressed to move said inner plate to contact said second electrical control unit so as to generate the second electrical control signal for driving electrically said transmission unit; and wherein, in the continuous shooting mode, (i) said inner plate is set in a high point position relative to said trigger, (ii) said trigger is depressed to contact said first electrical control unit so as to generate the first electrical control signal for driving electrically said kinetic power unit, and (iii) the safety member is pressed against the article to move said inner plate to contact said second electrical control unit so as to generate the second electrical control signal for driving electrically said transmission unit.

2. The electric nail gun as claimed in claim 1, wherein said trigger has an abutment surface that faces toward said first electrical control unit and that is rotatable to contact one of said two protrusions of said touch member of said first electrical control unit to allow the first electrical control signal to be output from said contact switch of said first electrical control unit.

3. The electric nail gun as claimed in claim 1, wherein said first electrical control unit further includes a mounting member disposed between said safety member and said contact switch and permitting said touch member to be disposed movably therein, and a resilient member disposed between said mounting member and said touch member for biasing said touch member away from said contact switch.

4. The electric nail gun as claimed in claim 1, wherein said safety member has an abutting portion at an end thereof, said abutting portion being movable into contact with a corresponding one of said protrusions of said touch member.

5. The electric nail gun as claimed in claim 1, wherein said inner plate has a lower end, and said trigger unit includes a rotating member disposed pivotally on said trigger and provided with an eccentric pin connected pivotally to said lower end of said inner plate, such that said rotating member can be rotated to move said inner plate relative to said safety member between the high and lower point positions.

6. The electric nail gun as claimed in claim 1, wherein said second electrical control unit includes a contact switch and a touch member movable relative to said contact switch, said touch member having a contact portion and a protrusion contactable with and movable by said inner plate to allow said contact portion to move into contact with said contact switch.

7. The electric nail gun as claimed in claim 6, wherein said second electrical control unit further includes a mounting member disposed between said inner plate and said contact switch and permitting said touch member to be disposed movably therein, and a resilient member disposed between said mounting member and said touch member for biasing said touch member away from said contact switch.

8. The electric nail gun as claimed in claim 1, wherein said safety member has an end that is formed with a notch and that is movable to contact said inner plate in such a manner that said inner plate engages said notch, thereby pushing said inner plate into contact with said second electrical control unit when said safety member is pressed against the article.

* * * * *